US010304593B2

(12) United States Patent
Ouyang et al.

(10) Patent No.: US 10,304,593 B2
(45) Date of Patent: May 28, 2019

(54) DATA CARRYING CABLE WITH MIXED-GAUGE CONDUCTORS TO ACHIEVE LONGER REACH AND FLEXIBILITY

(71) Applicant: Microsoft Technology Licensing, LLC, Redmond, WA (US)

(72) Inventors: Gong Ouyang, Bellevue, WA (US); Mark A. Shaw, Sammamish, WA (US); Alexander Levin, Seattle, WA (US); Martha Geoghegan Peterson, Woodinville, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/789,637

(22) Filed: Oct. 20, 2017

(65) Prior Publication Data

US 2019/0122789 A1 Apr. 25, 2019

(51) Int. Cl.

| | |
|---|---|
| ***H01B 11/18*** | (2006.01) |
| ***H01P 1/20*** | (2006.01) |
| ***H01B 11/20*** | (2006.01) |
| ***H01B 11/00*** | (2006.01) |
| ***H01B 11/08*** | (2006.01) |

(52) U.S. Cl.
CPC ..... *H01B 11/20* (2013.01); *H01B 11/002* (2013.01); *H01B 11/08* (2013.01)

(58) Field of Classification Search
CPC ..... H01B 11/18; H01P 1/20
USPC ..... 174/28, 88 R, 115; 333/34
See application file for complete search history.

(56) References Cited

U.S. PATENT DOCUMENTS

| | | | | |
|---|---|---|---|---|
| 2,269,991 A * | 1/1942 | Scheldorf | H01B 11/186 | 174/28 |
| 2,438,915 A * | 4/1948 | Hansen | H01P 1/266 | 333/22 R |
| 3,590,207 A | 6/1971 | Cox | | |
| 3,909,755 A * | 9/1975 | Kaunzinger | H01P 1/201 | 333/206 |
| 3,912,854 A * | 10/1975 | Thompson | H02G 15/18 | 174/76 |
| 4,937,401 A | 6/1990 | Lee | | |
| 6,046,665 A | 4/2000 | Oh et al. | | |
| 6,229,327 B1 * | 5/2001 | Boll | G01R 1/06772 | 324/755.02 |

(Continued)

OTHER PUBLICATIONS

"Flat Flexible Cables and Flat Cable Assemblies". Retrieved from: <<http://www.axon-cable.com/publications/FFC-Flat-Cables.pdf>>, Oct. 2016, 55 Pages.

*Primary Examiner* — Chau N Nguyen
(74) *Attorney, Agent, or Firm* — Alleman Hall Creasman & Tuttle LLP

(57) ABSTRACT

A data carrying cable to connect computing devices includes a first cable portion including a first conductor having a circular cross-section and a first gauge. A first port connector is connected to one end of the first cable portion. A second cable portion includes a second conductor having a circular cross-section and a second gauge that is different than the first gauge. The first conductor and the second conductor are arranged in series and are configured to carry a data signal between the computing devices.

20 Claims, 9 Drawing Sheets

(56) References Cited

U.S. PATENT DOCUMENTS

| | | | | |
|---|---|---|---|---|
| 6,307,156 | B1 | 10/2001 | Avellanet | |
| 6,444,915 | B1 * | 9/2002 | Wang | H01B 7/06 174/110 R |
| 6,734,362 | B2 | 5/2004 | Buck et al. | |
| 7,563,981 | B2 * | 7/2009 | Ichikawa | B60R 16/0215 174/102 R |
| 9,182,562 | B2 | 11/2015 | Peterson, III et al. | |
| 9,477,147 | B2 | 10/2016 | Chapman et al. | |
| 2016/0240297 | A1 | 8/2016 | Iwasa et al. | |
| 2016/0372909 | A1 | 12/2016 | Baldwin et al. | |

* cited by examiner

DATA CARRYING CABLE WITH MIXED-GAUGE CONDUCTORS TO ACHIEVE LONGER REACH AND FLEXIBILITY

FIELD

The present disclosure relates to data carrying cables for connecting computing devices, and more particularly to data carrying cables with mixed-gauge conductors for carrying data between computing devices.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Different types of interconnected computing devices such as switches, routers, servers and/or data storage devices are typically located in computer rooms or server rooms that may be a part of a datacenter, an on-premises computer system or other computing environment. Data centers may be used to provide remote, on-demand data storage, computing and/or software services to governmental entities, enterprises and/or consumers. The data centers rent resources such as physical machines, software, storage or other computing resources and allow the rented capacity to be automatically increased or decreased as demand changes.

The computing devices in the computer or server room of the datacenter are interconnected using data carrying cables such as Ethernet cables. Digital data is transmitted between the computing devices at very high data transmission rates. The computing devices are generally packed closely together. For example, the servers and switches may be arranged adjacent to one another on racks.

The computing devices generate a significant amount of heat during operation. Cooling airflow may be provided to cool the computing devices. In some installations, tight packing makes it difficult to cool the computing devices. Data attenuation can be affected by a number of factors including operating temperature, the length of the connecting cables and the gauge of the conductors that are used in the cables.

Ethernet cables may be used to physically connect ports of the switches to the servers. The cables are typically connected to ports of the server, bent (e.g. approximately 90°) and travel along a side of the rack. The cables are usually bent again (e.g. approximately 90°) and are connected to another device such as a switch or router. This physical layout allows the servers to be removed from the racks without being obstructed by the cables. However, this physical layout also tends to increase cable length, which increases insertion loss.

Cables using thinner gauge conductors can be used for improved bending flexibility and manageability. Cables using thinner gauge conductors are also easier to connect to small form factor connectors and tend to block less cooling air flow. As the cable length is increased, however, the insertion loss also increases due to increased effective resistance of the thinner gauge conductor. At high frequencies, current travels along an outer surface of the conductor due to field strength (inductance) (referred to as skin effect). Larger gauge cables have higher surface area than smaller gauge cables. Therefore, data carrying cables with thicker-gauge conductors are often used in applications requiring longer spans and higher data rates. For example, high speed Ethernet signaling (such as 50 Gb/s non-return to zero (NRZ) modulation) generally requires low insertion loss and therefore thicker gauge conductors are used.

SUMMARY

A data carrying cable to connect computing devices includes a first cable portion including a first conductor having a circular cross-section and a first gauge. A first port connector is connected to one end of the first cable portion. A second cable portion includes a second conductor having a circular cross-section and a second gauge that is different than the first gauge. The first conductor and the second conductor are arranged in series and are configured to carry a data signal between the computing devices.

In other features, one of: an opposite end of the first conductor is soldered to one end of the second conductor; or a continuous conductor is drawn into the first conductor having the first gauge and the second conductor having the second gauge.

In other features, a third cable portion includes a third conductor having a circular cross-section and the first gauge. The third conductor is arranged in series with the second conductor. A second port connector is connected to an opposite end of the third cable portion.

In other features, the first gauge is greater than the second gauge. The first gauge and the second gauge are in a range from 24 AWG to 34 AWG.

In other features, the first gauge is less than the second gauge. The first gauge and the second gauge are in a range from 24 AWG to 34 AWG.

In other features, a portion of the first conductor and the second conductor are twisted together and soldered. The opposite end of the first conductor of the first cable portion is flattened to define a flattened end and the one end of the second conductor is soldered to the flattened end. The continuous conductor is drawn to reduce the second gauge to the first gauge and to create the first conductor and the second conductor.

In other features, a first dielectric insulation layer is arranged around the first conductor. A second dielectric insulation layer is arranged around the second conductor.

In other features, a first ratio of a diameter of the first conductor to a first thickness of the first dielectric insulation layer is approximately equal to a second ratio of a diameter of the second conductor and a second thickness of the second dielectric insulation layer.

In other features, a first metal shield layer arranged around the first dielectric insulation layer. A second metal shield layer is arranged around the second dielectric insulation layer. A first sheath is arranged around the first metal shield layer. A second sheath is arranged around the second metal shield layer. The first sheath is made of a first material and the second sheath is made of a second material. The first material is more flexible than the second material.

In other features, the data carrying cable comprises one of an Ethernet cable and a twinax cable.

A method for manufacturing a data carrying cable to connect computing devices includes a) providing a first conductor having a circular cross-section and a first gauge; b) providing a second conductor having a circular cross-section and a second gauge that is different than the first gauge; c) arranging one end of the first conductor adjacent to one end of the second conductor; d) soldering the one end of the first conductor to the one end of the second conductor; and e) connecting an opposite end of the first conductor to a first port connector. The first conductor and the second conductor are configured to carry a data signal between the computing devices.

In other features, prior to e), the method includes f) providing a third conductor having a circular cross-section and the first gauge; g) arranging one end of the third conductor adjacent to an opposite end of the second conductor; h) soldering the one end of the third conductor to the opposite end of the second conductor; and i) connecting an opposite end of the third conductor to a second port connector.

In other features, prior to e), the method includes f) arranging a dielectric insulation layer around the first conductor and the second conductor. A first ratio of a first thickness of the dielectric insulation layer adjacent to the first conductor and the first gauge is approximately the same as a second ratio of a second thickness of the dielectric insulation layer adjacent to the second conductor and the second gauge. The method includes g) arranging a metal shield layer around the dielectric insulation layer; and h) arranging a sheath around the metal shield layer.

In other features, the method includes flattening at least one of the one end of the first conductor and the one end of the second conductor prior to d). The data carrying cable comprises one of an Ethernet cable and a twinax cable.

A method for manufacturing a data carrying cable to connect computing devices includes a) drawing one end of a continuous conductor into a first conductor having a circular cross-section and a first gauge and a second conductor having a circular cross-section and a second gauge that is different than the first gauge; and b) connecting an opposite end of the first conductor to a first port connector. The first conductor and the second conductor are configured to carry a data signal between the computing devices.

In other features, prior to b), the method includes c) drawing an opposite end of the continuous conductor into a third conductor having a circular cross-section and the first gauge; and d) connecting an opposite end of the third conductor to a second port connector.

In other features, prior to b), the method includes c) arranging a dielectric insulation layer around the first conductor and the second conductor. A ratio of a first thickness of the dielectric insulation layer adjacent to the first conductor and the first gauge is approximately the same as a ratio of a second thickness of the dielectric insulation layer adjacent to the second conductor and the second gauge. The method includes d) arranging a metal shield layer around the dielectric insulation layer; and e) arranging a sheath around the metal shield layer.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

A data carrying cable according to the present disclosure includes conductors having different gauges to address electrical signal loss, bend radius and/or length constraints for data carrying cables used to connect computing devices such as computers, laptops, notebooks, tablets, televisions, printers, tablets, phones, servers, routers, switches, and/or data storage devices such as solid state memory (e.g. flash memory) or hard disk drives. For example, the data carrying cable may be used to connect computing devices in a server room or a computer room and/or in data center applications. The data carrying cable is manufactured to provide excellent mechanical, thermal, and electrical performance while meeting the specific insertion loss and flexibility requirements for the datacenter rack.

Conductors of different gauges are soldered together in series (or a continuous conductor is drawn into different gauges) at different locations along the data carrying cable assembly to meet specific objectives. Thinner gauge conductors are used at locations where cable bending is needed, cable-connector terminations occur and/or in locations located in a cooling air flow path. Thinner gauge conductors are also used in locations where groups/bundles of cables need to fit in constrained areas or conduits. Conductors having larger gauges are used in remaining portions of the data carrying cable to reduce the insertion loss and to allow longer physical reach.

Figure 2:
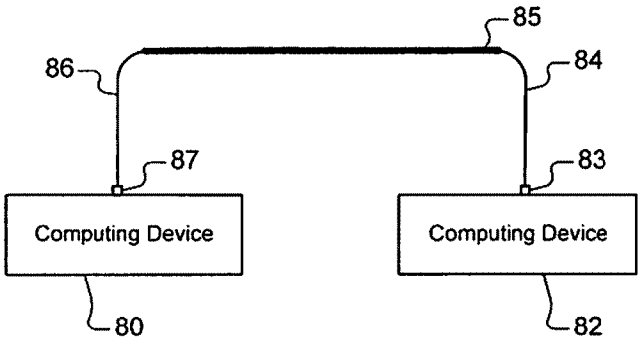
FIG. 2 is a functional block diagram illustrating first and second computing devices connected by a data carrying cable including multiple conductor gauges according to the present disclosure.
Figure 1:
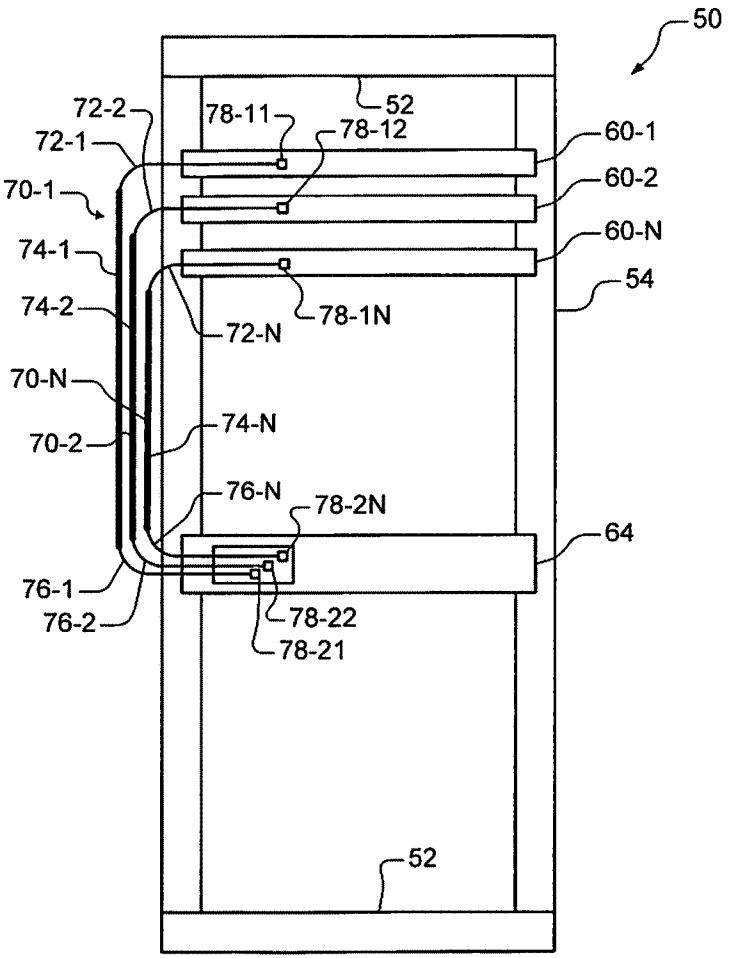
FIG. 1 is a functional block diagram of a rack including servers and a switch that are connected by data carrying cables each including multiple conductor gauges according to the present disclosure.

Referring now to FIGS. 1-2, examples of applications utilizing a data carrying cable including multiple gauge conductors are shown. While specific examples are shown herein in a data center context (e.g., as shown in FIG. 1), it will be appreciated that the data carrying cable including multiple gauge conductors according to the present disclosure can be used to carry data between any other types of computing devices (e.g., as shown in FIG. 2).

In FIG. 1, a rack 50 is shown that may be used in a computer room and/or a server room in a data center, enterprise system or other computing location. The rack 50 includes horizontal and vertical support members 52 and 54, respectively, and hardware (not shown) to allow computing devices such as servers, storage devices, routers and switches to be slidably attached to and removed from the rack 50. In the example in FIG. 1, servers 60-1, 60-2, . . . , and 60-N (collectively servers 60) are connected to a switch 64 by data carrying cables 70-1, 70-2, . . . 70-N (collectively data carrying cables 70). Each of the data carrying cables 70 includes two or more conductors that have two or more different gauges.

Each of the data carrying cables 70-1, 70-2, . . . 70-N includes first cable portions 72-1, 72-2, . . . 72-N (collectively first cable portions 72), respectively, including first conductors having a first gauge. Each of the data carrying cables 70-1, 70-2, . . . 70-N includes second cable portions 74-1, 74-2, . . . 74-N (collectively second cable portions 74) including second conductors having a second gauge that is different than the first gauge. Each of the data carrying cables 70-1, 70-2, and 70-N may further include one or more additional cable portions 76-1, 76-2, . . . 76-N (collectively additional cable portions 76) including additional conductors having the first gauge, the second gauge or another gauge. In some examples, the first gauge is smaller than the second gauge. In some examples, the first gauge is larger than the second gauge.

In some examples, the first cable portions 72 and the additional cable portions 76 are located at opposite ends of the data carrying cables 70 and the second cable portions are located at mid-portions thereof. Opposite ends of the data carrying cables 70-1, 70-2, . . . and 70-N include port connectors 78-11 and 78-21, 78-12 and 78-22, and 78-1N and 78-2N, respectively, to allow connection to a port of the servers 60 or the switch 64. Examples of port connectors 78 include coaxial connectors, printed circuit board connectors, paddle cards, register jack (RJ) connectors, or any other type of end connectors.

As noted above, the cables with multiple gauge conductors are not limited to carrying data between servers or switches. In FIG. 2, first and second computing devices 80, 82 are connected by the data carrying cable including multiple conductor gauges. The first and second computing devices 80, 82 can be any type of computing device such as computers, laptops, notebooks, tablets, televisions or other displays, printers, tablets, phones, servers, routers, switches, memory such as solid state memory and/or data storage devices. More particularly, the data carrying cable includes a first port connector 83, a first cable portion 84 including one or more conductors having a first gauge, a second cable portion 85 including one or more conductors having a second gauge, a third cable portion 86 including one or more conductors having the first gauge, the second gauge or another gauge and a connector 87. The first, second and third cable portions are arranged in series.

Figure 3A:
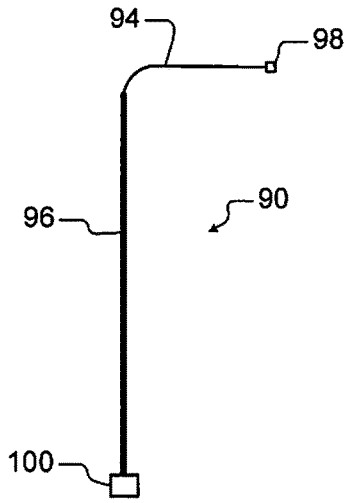
FIGS. 3A-3C illustrate variations of a data carrying cable including multiple conductor gauges according to the present disclosure.
Figure 3B:
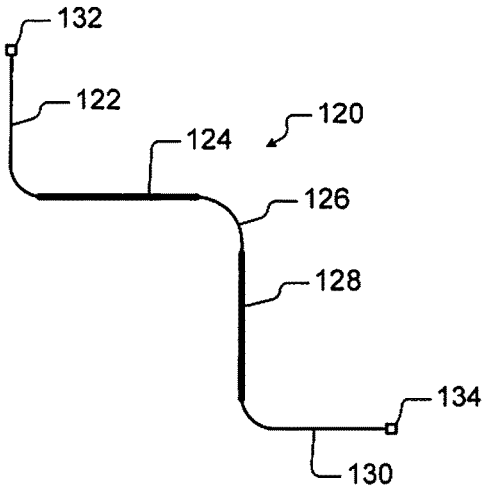
Figure 3C:
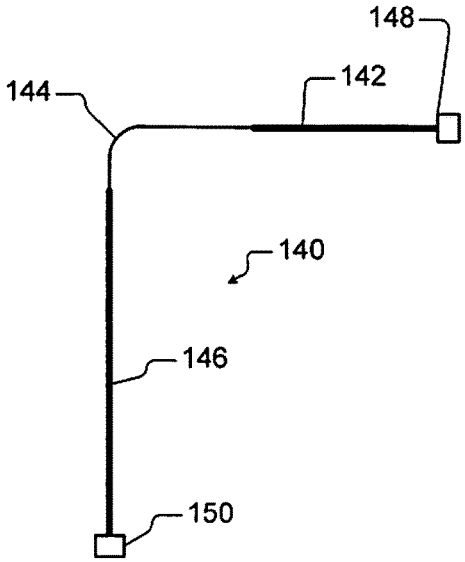

Referring now to FIGS. 3A-3C, the specific configurations of the data carrying cables including conductors having different gauges may be varied from the examples shown in FIGS. 1 and 2. In FIG. 3A, a data carrying cable 90 includes a first cable portion 94 including a conductor having a first gauge and a second cable portion 96 including a conductor having a second gauge. A port connector 98 is connected to an end of the first cable portion 94 and a port connector 100 is connected to an end of the second cable portion 96. In some examples, the first gauge is smaller than the second gauge. In this example, the first cable portion 94 is arranged to allow bending and the second cable portion 96 is a straight connection without bending or with limited bending.

In FIG. 3B, another data carrying cable configuration is shown. A data carrying cable 120 includes a first cable portion 122 including conductors having a first gauge, a second cable portion 124 including conductors having a second gauge, a third cable portion 126 including conductors having the first gauge (or another gauge), a fourth cable portion 128 including conductors having the second gauge, and a fifth cable portion 130 including conductors having the first gauge (or another gauge). A port connector 132 is connected to the first cable portion 122. A port connector 134 is connected to the fifth cable portion 130.

In FIG. 3C, another data carrying cable configuration is shown. A data carrying cable 140 includes a first cable portion 142 having a second gauge, a second cable portion 144 having a first gauge, and a third cable portion 146 having the second gauge. A port connector 148 is connected to the first cable portion 142. A port connector 150 is connected to the third cable portion 146. In some examples, the first gauge, the second gauge and/or other gauges are in a range from 24 AWG to 34 AWG, although other gauges can be used.

Figure 4A:
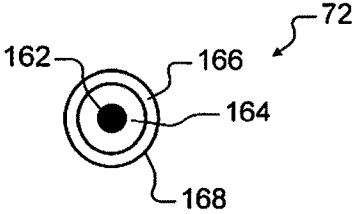
FIGS. 4A and 4B are cross-sectional views illustrating varying diameters of the data carrying cables along different lengths thereof.
Figure 4B:
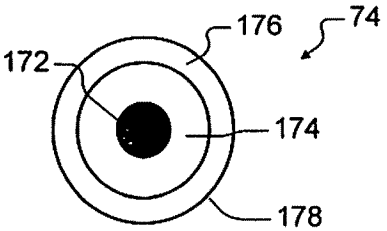

Referring now to FIGS. 4A and 4B, example cross-sections of the data carrying cable 70 along the first cable portion 72 and the second cable portion 74 are shown, respectively. In FIG. 4A, a conductor 162 having the first gauge is surrounded by an insulating dielectric layer 164. In some examples, the conductor 162 has a circular cross-section. In other examples, the conductor 162 has a rectangular or square cross-section. A metal shield 166 surrounds the insulating dielectric layer 164. A sheath 168 surrounds the metal shield 166. Likewise in FIG. 4B, a conductor 172 having the second gauge is surrounded by an insulating dielectric layer 174. A metal shield 176 surrounds the insulating dielectric layer 174. A sheath 178 surrounds the metal shield 176.

In some examples, rigidity of material used for the sheath can be varied according to transverse locations along the cable length. For example, higher rigidity can be used over cable portions including conductors with larger gauges (where less bending occurs). Lower rigidity can be used over cable portions including conductors with smaller gauges. Sheath sections with different rigidity may be heat treated to provide a seal and/or provided as a continuous sheath material (with different rigidity sections) to protect conductors located inside.

A transition region may be located between the first cable portion and the second cable portion as will be described further below. In some examples, the conductor gradually transitions from the first gauge to the second gauge in the transition region. In other examples, the conductor has a step change from the first gauge to the second gauge.

Figure 5A:
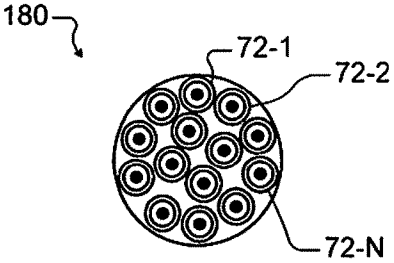
FIGS. 5A and 5B are cross-sectional views illustrating bundling of varying diameters of the data carrying cables along different lengths thereof.
Figure 5B:
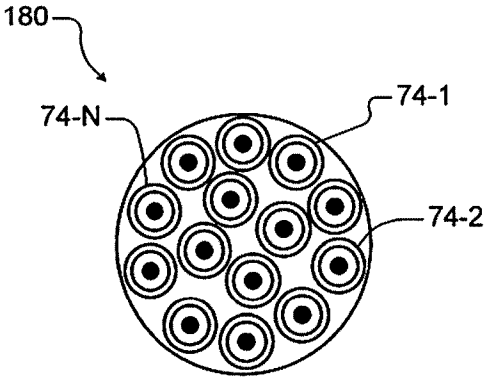

Referring now to FIGS. 5A and 5B, multiple data carrying cables can be bundled together. In FIG. 5A, a cross-section of a data carrying cable bundle 180 located adjacent to the first cable portion 72 is shown. In FIG. 5B, a cross-section of the data carrying cable bundle 180 located adjacent to the second cable portion 74 is shown. As can be appreciated, it is easier to bend the data carrying cable bundle 180 in locations corresponding to the first cable portion 72 as compared to bending the data carrying cable bundle 180 in locations corresponding to the second cable portion 74.

Figure 6A:
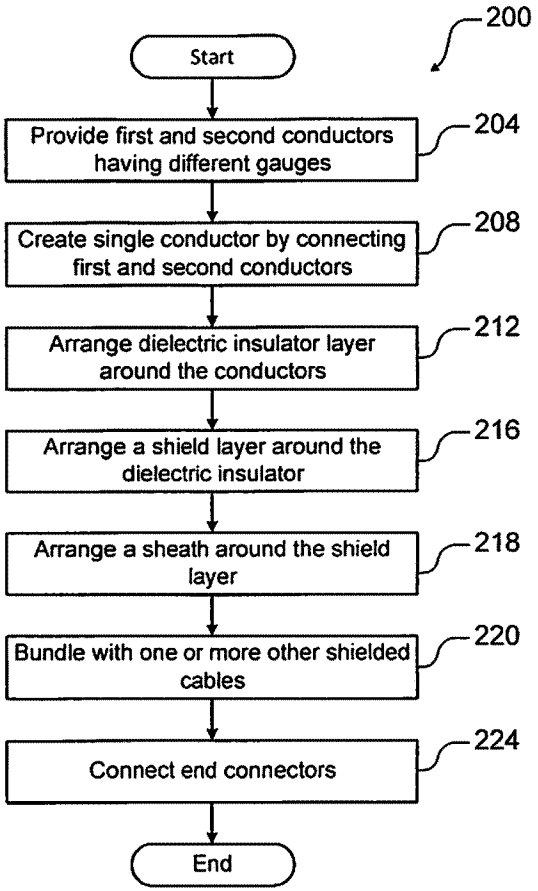
FIGS. 6A and 6B are flowcharts illustrating examples of methods for manufacturing a data carrying cable having multiple conductor gauges along different lengths thereof.
Figure 6B:
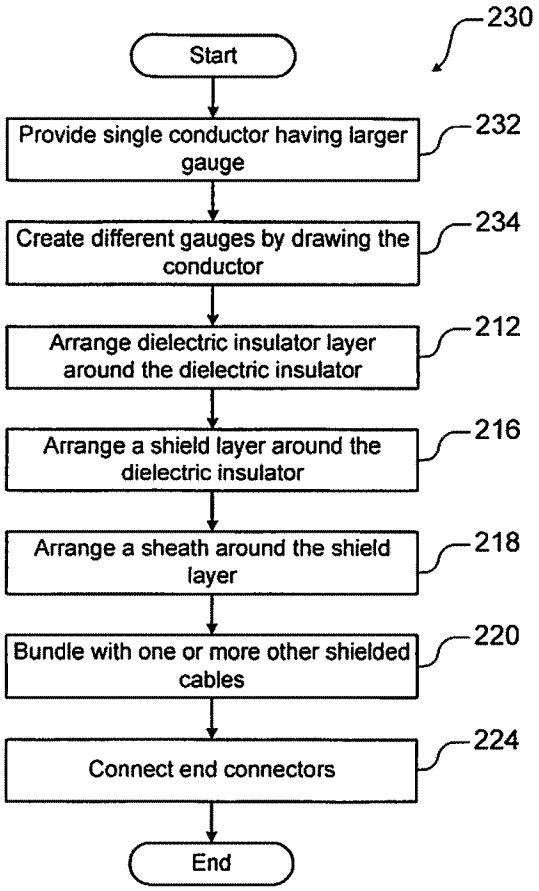

Referring now to FIGS. 6A and 6B, various examples of methods for manufacturing a data carrying cable having multiple conductor gauges is shown. In FIG. 6A, a method 200 for manufacturing a data carrying cable having multiple conductor gauges along a length thereof using soldering is shown. At 204, first and second conductors having different gauges are provided. At 208, a single conductor is created by electrically connecting the first and second conductors together. For example, the first conductor is soldered to the second conductor. In some examples, heat treatment such as annealing is performed to improve the electrical characteristics of the joint. While soldering is shown, a mechanical connector (not shown) may be used in addition to or instead of soldering.

At 212, a dielectric insulator layer is arranged around the first and second conductors. In some examples, the radial thickness of the dielectric insulator layer at a given location is based on the gauge of the conductor at that location. At 216, a shield layer is arranged around the dielectric insulator layer. At 218, a sheath is arranged around the shield layer. At 220, the data carrying cable may be bundled with one or more other data carrying cables. At 224, port connectors may be connected to the conductors.

In FIG. 6B, an alternative method 230 for creating the data carrying cable including multiple gauges is shown. At 232, a single conductor having a larger gauge is provided. At 234, the single conductor is drawn to create a first conductor portion having a smaller gauge and a second conductor portion having the larger gauge. The process can be repeated one or more times to define additional conductor portions having additional gauges and/or the first gauge.

Figure 7:
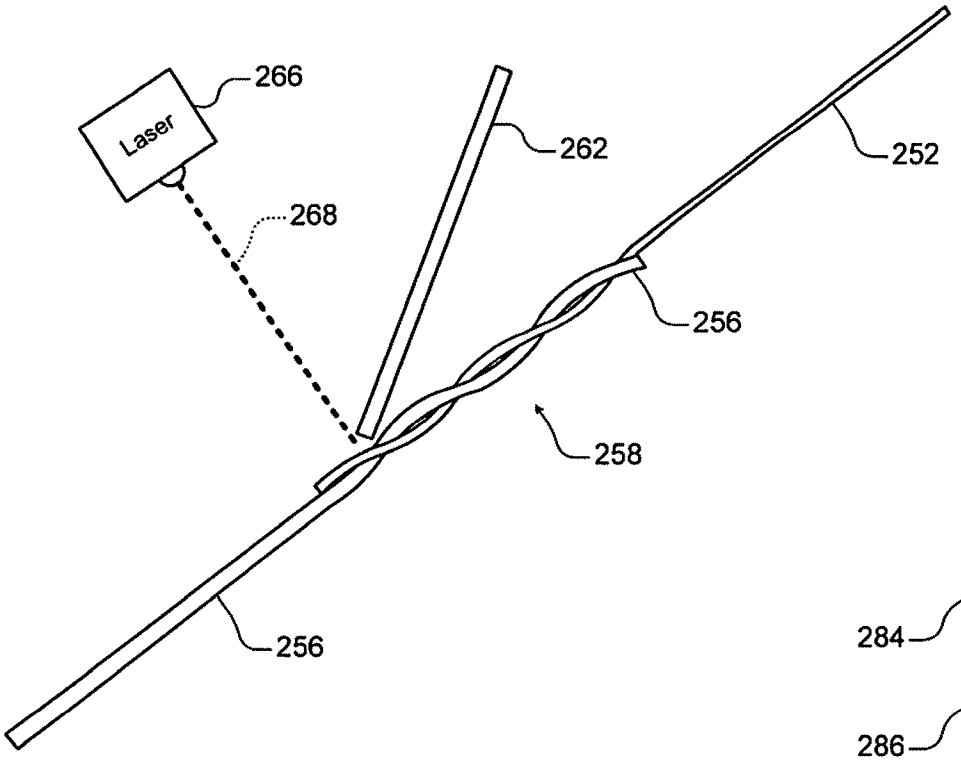
FIG. 7 is a perspective view illustrating soldering of first and second conductors having different gauges.
Figure 8:
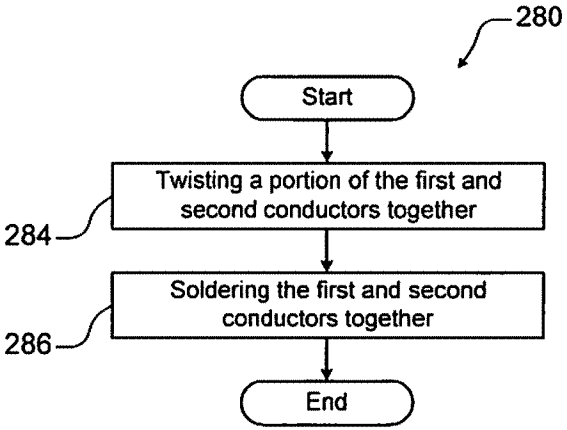
FIG. 8 is a flowchart illustrating an example of a method for soldering first and second conductors having different gauges.

Referring now to FIGS. 7-8, first and second conductors having different gauges are soldered together. In FIG. 7, a first conductor 252 and a second conductor 256 are twisted together in a region 258. Solder 262 is heated by light 268 produced by a laser 266 or another heat source such as a soldering gun to solder the first conductor 252 to the second conductor 256. The soldering can be performed along the entire length of the region 258 or a portion thereof.

In FIG. 8, a method 280 for soldering first and second conductors having different gauges is shown. At 284, portions of the first and second conductors are twisted together in a predetermined region. At 286, the first and second conductors are soldered together in the region that was twisted together.

Figure 10:
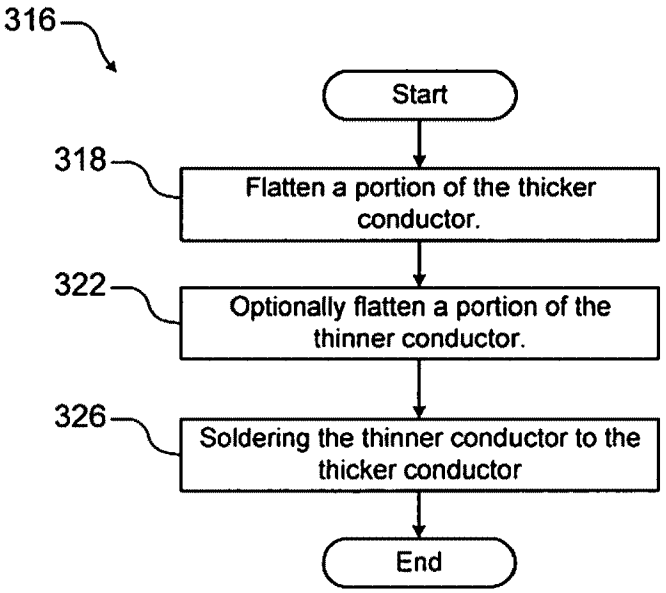
FIG. 10 is a flowchart illustrating an example of a method for soldering first and second conductors (having different gauges) together by flattening an end of one or more of the first and second conductors.
Figure 9:
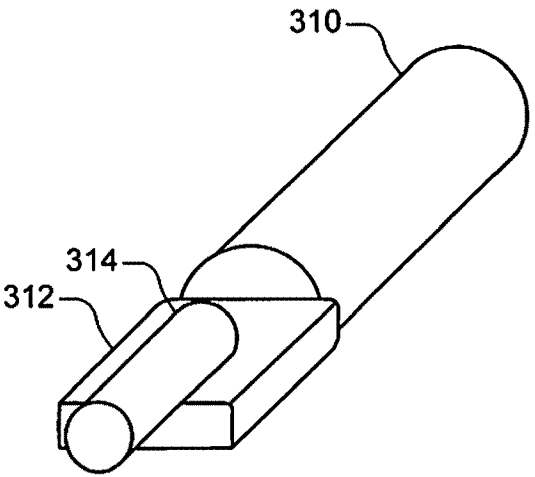
FIG. 9 is a perspective view illustrating flattening of an end of one or more of the conductors having different gauges during soldering.

Referring now to FIGS. 9-10, there are a number of other methods for soldering the conductors together. In FIG. 9, an end of one or more of the conductors is flattened prior to soldering. For example, a first conductor 310 corresponding to the larger gauge includes an end 312 that is flattened. A second conductor 314 is soldered to the end 312. In FIG. 10, a method 316 for soldering the conductors together is shown. At 318, a portion of the conductor having the larger gauge is flattened using a press, a vice or other mechanical device. At 322, a portion of the conductor having the smaller gauge may also be flattened. At 326, conductors are soldered together.

Figure 11:
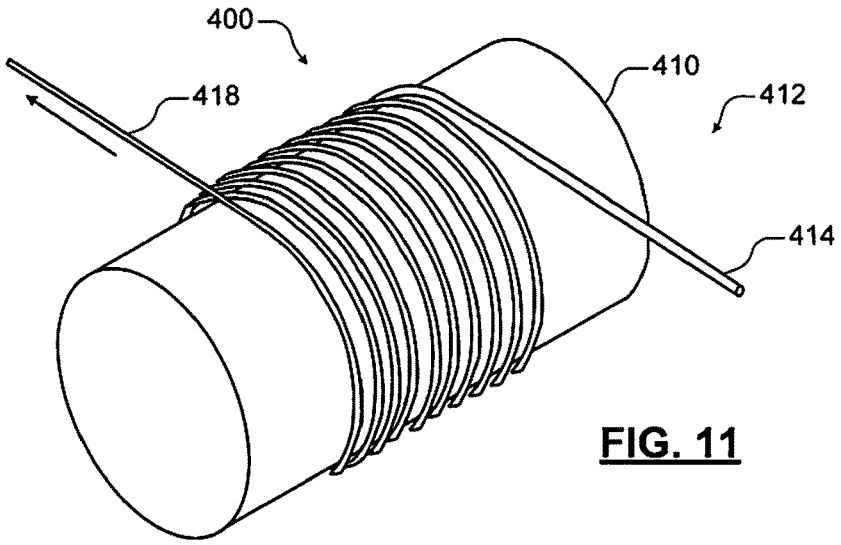
FIG. 11 is a perspective view illustrating drawing of an end of a conductor having a thicker gauge into a thinner gauge portion.

Referring now to FIG. 11, a conductor 412 having first conductor 414 with a larger gauge can be drawn into a second conductor 418 with a smaller gauge. For example, the first conductor 114 of the conductor 412 may be wound around a cylinder 410. Drawing force may be applied to one end of the conductor 412 in a direction indicated by arrow at a rate that is higher than a turning rate of the cylinder 410. The end of the conductor 412 will elongate to create a smaller gauge. The drawing force may be varied during drawing to provide a transition region between the smaller gauge and the larger gauge as will be described below.

Figure 12:
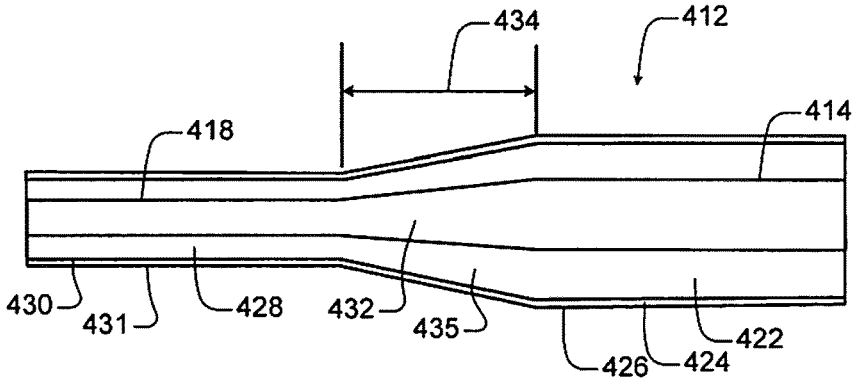
FIG. 12 is a side cross-sectional view of a conductor having multiple gauge regions and a transition region between the multiple gauge regions.

Referring now to FIG. 12, the conductor 412 is shown in additional detail. The conductor 412 includes the first conductor portion 414 having the larger gauge and the second conductor portion 418 having the smaller gauge. The first conductor 414 has an outer diameter $D_{11}$. A dielectric insulator layer 422 is arranged around the first conductor portion 414 and has a thickness $D_{12}$. A metal shield layer 424 and a sheath 426 may be provided.

The second conductor 418 has an outer diameter $D_{21}$. A dielectric insulator layer 422 is arranged around the second conductor portion 418 and has a thickness $D_{22}$. A transition portion 430 has a varying diameter $D_{T1}$. A metal shield layer 430 and a sheath 431 may be provided. A dielectric insulator layer 435 is arranged around the conductor 432 in a transition region 434 and has a varying thickness $D_{T2}$. In some examples, ratios of $D_{11}/D_{12}$, $D_{12}/D_{22}$ and $D_{T1}/D_{T2}$ (at various transverse locations along the cable length) are approximately equal. As used herein, the term approximately means within 10%, 5%, or 1%.

Figure 13:
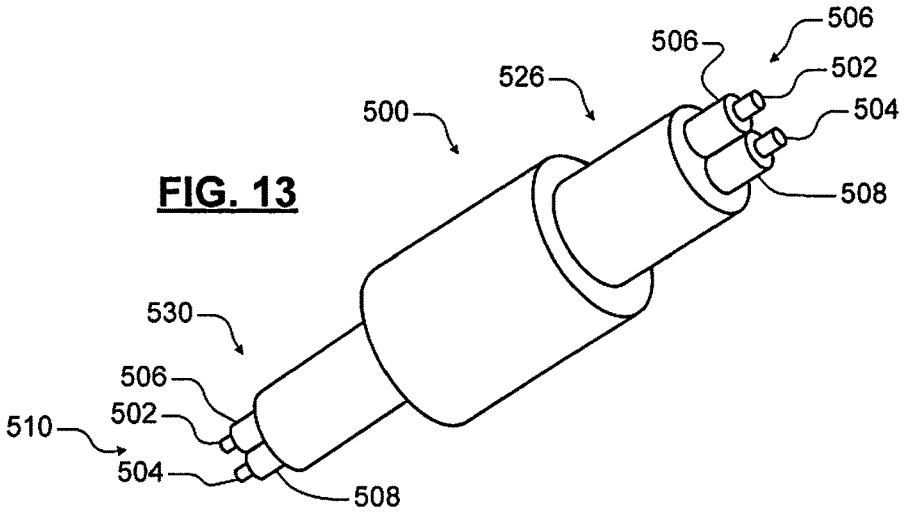
FIG. 13 is a perspective view of a twin axial (twinax) data carrying cable having conductors including multiple gauges.

Referring now to FIG. 13, other types of data carrying cables can also utilize conductors having multiple gauges. For example, a twin axial data carrying cable 500 includes first and second conductors 502 and 504 that are surrounded by dielectric insulation layers 506 and 508. The first and second conductors 502 and 504 transition in a transition region 520 from a larger gauge at a location 526 to a smaller gauge at a location 530. In some examples, the diameter of the dielectric insulation layers 506 and 508 also transition from a larger diameter at the location 526 to a smaller diameter at the location 530. As with the preceding examples, a shield layer and a sheath (both not shown) may be used.

While the foregoing examples related to coaxial and twinax data carrying cables, a similar approach can be used for conductors in other high speed data carrying cables such as universal serial bus (USB), serial advanced technology attachment (SATA), and Serial-Attached SCSI (Small Computer System Interface) (SAS) data carrying cables.

As used herein, high speed refers to data rates greater than 1 Gb/s. In some examples, the cables include two different gauges and the smaller gauge cable portions span less than 30% of the length of the cable. In some examples, the cables include two different gauges and the smaller gauge cable portions span less than 25% of the overall length of the cable. In some examples, the cables include two different gauges and the smaller gauge cable portions span from 10% to 30% of the overall length of the cable.

Figure 14A:
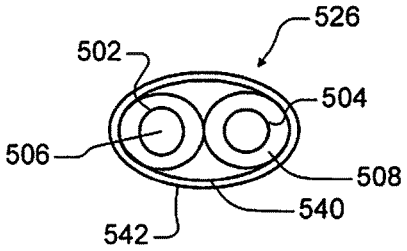
FIGS. 14A and 14B are cross-sectional views of a twinax cable according to the present disclosure at different locations.
Figure 14B:
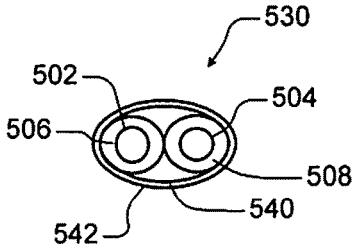

Referring now to FIGS. 14A to 15B, variations of the twinax cable are shown. In FIGS. 14A and 14B, a twinax cable is shown at the different locations 526 and 530, respectively corresponding to smaller and larger gauges, along a length of the twinax cable. The twinax cable includes the conductors 502 and 504, the insulating dielectric layers 506 and 508, a metal shield layer 540 surrounding the insulating dielectric layers 506 and 508, and a sheath 542 surrounding the metal shield layer 540.

Figure 15A:
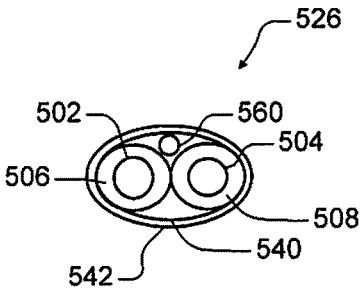
FIGS. 15A and 15B are cross-sectional views of a twinax cable with a drain conductor according to the present disclosure at different locations.
Figure 15B:
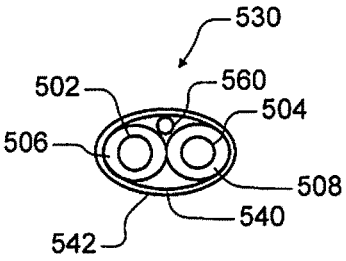

In FIGS. 15A and 15B, a twinax cable is shown at the different locations 526 and 530, respectively corresponding to smaller and larger gauges, along a length of the twinax cable. The twinax cable includes a drain conductor 560 arranged between the insulating dielectric layers 506 and 508 and the metal shield layer 540.

Figure 16:
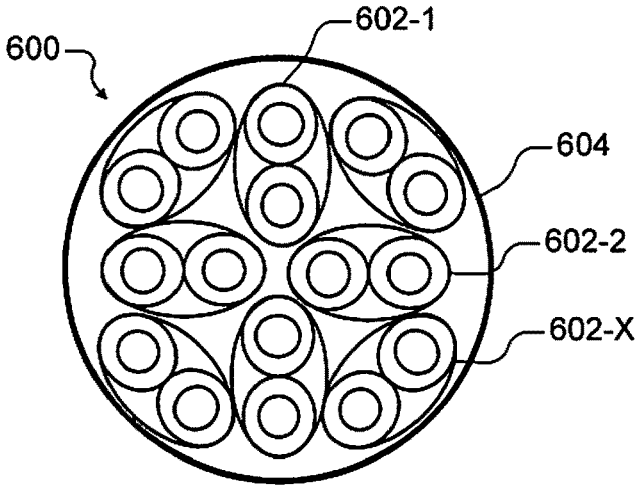
FIG. 16 illustrates a bundle of twinax cables according to the present disclosure.
Figure 17:
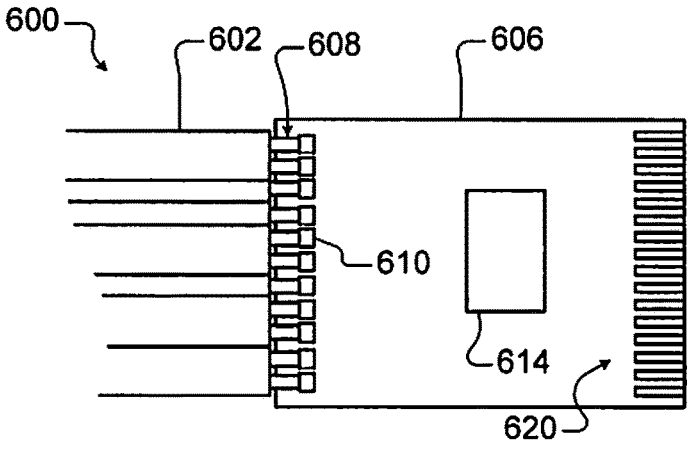
FIG. 17 is a plan view illustrating a bundle of twinax cables connected to a printed circuit board (PCB) according to the present disclosure.

Referring now to FIGS. 16-17, a plurality of the twinax cables can be arranged together in a bundle. In FIG. 16, a bundle 600 includes twinax cables 602-1, 602-2, . . . and 602-X (collectively twinax cables 602). An outer sheath 604 surrounds the twinax cables 602. In FIG. 17, the bundle 600 of twinax cables are connected to a printed circuit board (PCB), paddle card or wire termination generally identified at 606. Conductors 608 of the twinax cables 602 are connected to traces or conductors 610 that are connected by internal traces (not shown) to one or more circuits, integrated circuits, discrete electrical components (generally identified by 614) and/or directly or indirectly to terminals 620.

EXAMPLE

In one example, a cable having a length of 3 m is desired. A cable made using 26 AWG has 4 dB/m or 12 dB insertion loss at a 25 Gb/s data rate. Connectors at each end have 1.07 dB loss (per IEEE Specification 802.3by, FIG. 110A-1). The total loss for the 26 AWG cable and connectors would be 12 dB+2*1.07 dB=14.14 dB.

A 3 m cable made using 30 AWG has 6 dB/m or 18 dB insertion loss at a 25 Gb/s data rate. The total loss for the 30 AWG cable and connectors would be 18 dB+2*1.07 dB=20.14 dB. If the specification allows 15.5 dB cable loss (such as in I.E.E.E. 802by specification), the cable using 30 AWG cannot be used. The cable made using 26 AWG meets the specification but has issues with respect to flexibility and larger form factor port connectors.

According to the present disclosure, a 3 m cable is made using 0.68 m of 30 AWG cable (0.34 m would be used at each end to provide a desirable bend radius) and 2.32 m 26 AWG cable (for the middle portion). The total loss for the combination gauge cable and connectors would be 0.68 m*6 dB/m+2.32 m*4 dB/m+2*1.07 dB=15.5 dB. The specification is met with increased flexibility at the ends.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules) are described using various terms, including "connected," "engaged," "interfaced,", "mated" and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

The invention claimed is:

1. A data carrying cable to connect computing devices, comprising:

a first cable portion including a first conductor having a circular cross-section and a first gauge;

a first port connector connected to one end of the first cable portion;

a second cable portion including a second conductor having a circular cross-section and a second gauge that is different than the first gauge;

a first dielectric insulation layer arranged around the first conductor; and a second dielectric insulation layer arranged around the second conductor, wherein the first conductor and the second conductor are arranged in series and are configured to carry a data signal between the computing devices, wherein a first ratio of a diameter of the first conductor to a first thickness of the first dielectric insulation layer is approximately equal to a second ratio of a diameter of the second conductor to a second thickness of the second dielectric insulation layer.

2. The data carrying cable of claim 1, wherein one of:

an opposite end of the first conductor is soldered to one end of the second conductor; or a continuous conductor is drawn into the first conductor having the first gauge and the second conductor having the second gauge.

3. The data carrying cable of claim 2, wherein the continuous conductor is drawn to reduce the second gauge from the first gauge and to create the first conductor and the second conductor.

4. The data carrying cable of claim 1, further comprising:

a third cable portion including a third conductor having a circular cross-section and the first gauge, wherein the third conductor is arranged in series with the second conductor; and a second port connector connected to an opposite end of the third cable portion.

5. The data carrying cable of claim 1, wherein the first gauge is greater than the second gauge and wherein the first gauge and the second gauge are in a range from 24 AWG to 34 AWG.

6. The data carrying cable of claim 1, wherein the first gauge is less than the second gauge and wherein the first gauge and the second gauge are in a range from 24 AWG to 34 AWG.

7. The data carrying cable of claim 1, wherein a portion of the first conductor and the second conductor are twisted together and soldered.

8. The data carrying cable of claim 1, wherein an opposite end of the first conductor of the first cable portion is flattened to define a flattened end and one end of the second conductor is soldered to the flattened end.

9. The data carrying cable of claim 1, further comprising:

a first metal shield layer arranged around the first dielectric insulation layer;

a second metal shield layer arranged around the second dielectric insulation layer;

a first sheath arranged around the first metal shield layer; and a second sheath arranged around the second metal shield layer.

10. The data carrying cable of claim 9, wherein the first sheath is made of a first material and the second sheath is made of a second material, and wherein the first material is more flexible than the second material.

11. The data carrying cable of claim 1, further comprising:

a transition region disposed between the first cable portion and the second cable portion and including a third conductor having a circular cross-section, wherein a gauge of the third conductor transitions from the first gauge to the second gauge.

12. The data carrying cable of claim 11, further comprising:

a third dielectric insulation layer arranged around the third conductor and having a diameter that transitions from a diameter of the first dielectric insulation layer to a diameter of the second dielectric insulation layer.

13. A method for manufacturing a data carrying cable to connect computing devices, comprising:

a) providing a first conductor having a circular cross-section and a first gauge;

b) providing a second conductor having a circular cross-section and a second gauge that is different than the first gauge;

c) arranging a dielectric insulation layer around the first conductor and the second conductor, wherein a ratio of a first thickness of the dielectric insulation layer adjacent to the first conductor and the first gauge is approximately the same as a ratio of a second thickness of the dielectric insulation layer adjacent to the second conductor and the second gauge;

d) arranging one end of the first conductor adjacent to one end of the second conductor;

e) soldering the one end of the first conductor to the one end of the second conductor; and f) connecting an opposite end of the first conductor to a first port connector, wherein the first conductor and the second conductor are configured to carry a data signal between the computing devices.

14. The method of claim 13, further comprising:

prior to f):

g) providing a third conductor having a circular cross-section and the first gauge;

h) arranging one end of the third conductor adjacent to an opposite end of the second conductor;

i) soldering the one end of the third conductor to the opposite end of the second conductor; and j) connecting an opposite end of the third conductor to a second port connector.

15. The method of claim 13, further comprising:

prior to f):

g) arranging a dielectric insulation layer around the first conductor and the second conductor, wherein a first ratio of a first thickness of the dielectric insulation layer adjacent to the first conductor and the first gauge is approximately the same as a second ratio of a second thickness of the dielectric insulation layer adjacent to the second conductor and the second gauge;

h) arranging a metal shield layer around the dielectric insulation layer; and i) arranging a sheath around the metal shield layer.

16. The method of claim 15, further comprising flattening at least one of the one end of the first conductor and the one end of the second conductor prior toe).

17. The method of claim 13, wherein the data carrying cable comprises one of an Ethernet cable and a twinax cable.

18. A method for manufacturing a data carrying cable to connect computing devices, comprising:

a) drawing one end of a continuous conductor into a first conductor having a circular cross-section and a first gauge and a second conductor having a circular cross-section and a second gauge that is different than the first gauge;

b) arranging a dielectric insulation layer around the first conductor and the second conductor, wherein a ratio of a first thickness of the dielectric insulation layer adjacent to the first conductor and the first gauge is approximately the same as a ratio of a second thickness of the dielectric insulation layer adjacent to the second conductor and the second gauge; and c) connecting an opposite end of the first conductor to a first port connector, wherein the first conductor and the second conductor are configured to carry a data signal between the computing devices.

19. The method of claim 18, further comprising:

prior to b):

d) drawing an opposite end of the continuous conductor into a third conductor having a circular cross-section and the first gauge; and e) connecting an opposite end of the third conductor to a second port connector.

20. The method of claim 18, further comprising:

prior to c):

d) arranging a metal shield layer around the dielectric insulation layer; and e) arranging a sheath around the metal shield layer.

* * * * *